US008170732B2

(12) United States Patent
Daum et al.

(10) Patent No.: US 8,170,732 B2
(45) Date of Patent: May 1, 2012

(54) SYSTEM AND METHOD FOR OPERATING TRAIN IN THE PRESENCE OF MULTIPLE ALTERNATE ROUTES

(75) Inventors: Wolfgang Daum, Erie, PA (US); Timothy Rolbiecki, Grain Valley, MO (US)

(73) Assignee: General Electric Company, Schenectady, NY (US)

( * ) Notice: Subject to any disclaimer, the term of this patent is extended or adjusted under 35 U.S.C. 154(b) by 484 days.

(21) Appl. No.: 12/405,654

(22) Filed: Mar. 17, 2009

(65) Prior Publication Data

US 2009/0230254 A1 Sep. 17, 2009

Related U.S. Application Data

(60) Provisional application No. 61/037,241, filed on Mar. 17, 2008.

(51) Int. Cl.
*G05D 1/00* (2006.01)

(52) U.S. Cl. ..... 701/19; 701/200; 701/208; 701/202; 701/213

(58) Field of Classification Search ..... 701/19, 701/20, 200, 201, 205, 213, 212, 208, 209, 701/202; 246/2 R, 3, 4, 5, 6, 14, 15, 62, 246/22 R, 160, 162, 167 R, 177
See application file for complete search history.

(56) References Cited

U.S. PATENT DOCUMENTS

| | | | | |
|---|---|---|---|---|
| 3,963,203 | A * | 6/1976 | Pascoe | 246/134 |
| 4,066,228 | A * | 1/1978 | Elder | 246/5 |
| 4,553,723 | A | 11/1985 | Nichols et al. | |
| 4,582,280 | A | 4/1986 | Nichols et al. | |
| 5,340,062 | A | 8/1994 | Heggestad | |
| 5,398,894 | A * | 3/1995 | Pascoe | 246/28 R |
| 5,452,870 | A | 9/1995 | Heggestad | |
| 5,533,695 | A * | 7/1996 | Heggestad et al. | 246/62 |
| 6,400,281 | B1 | 6/2002 | Darby, Jr. et al. | |
| 6,459,695 | B1 | 10/2002 | Schmitt | |
| 2006/0212189 | A1 * | 9/2006 | Kickbusch et al. | 701/19 |
| 2007/0219682 | A1 | 9/2007 | Kumar et al. | |
| 2007/0225878 | A1 | 9/2007 | Kumar et al. | |
| 2007/0260367 | A1 * | 11/2007 | Wills et al. | 701/19 |

* cited by examiner

*Primary Examiner* — Mark Le
(74) *Attorney, Agent, or Firm* — Shawn McClintic; Trego, Hines & Ladenheim

(57) ABSTRACT

A method is provided for operating a train or rail vehicle along a railway which is logically divided into segments, and includes at least one control point presenting at least two possible paths that are exclusive of each other, each path including one or more segments. The method includes: (a) controlling the rail vehicle as it travels along the railway by reference to a one-dimensional representation of the segments prior to the control point; (b) determining which segment located immediately past the control point is to be occupied by the rail vehicle; (c) after the rail vehicle has traveled past the at least one control point, verifying which segment was occupied; (d) interlocking the occupied segment; (e) passing segment information to the rail vehicle; and (f) controlling the rail vehicle as it travels along the railway in reference to a one-dimensional representation of the segments past the control point.

17 Claims, 4 Drawing Sheets

SYSTEM AND METHOD FOR OPERATING TRAIN IN THE PRESENCE OF MULTIPLE ALTERNATE ROUTES

CROSS-REFERENCE TO RELATED APPLICATIONS

This application claims the benefit of U.S. Provisional Patent Application No. 61/037,241 filed Mar. 17, 2008.

BACKGROUND OF THE INVENTION

This invention relates to controlling train operations, and more particularly to controlling a train's operations in the presence of alternate paths which are not predetermined before the beginning of a trip.

BACKGROUND OF THE INVENTION

Automatic Train Operation ("ATO") systems, such as GE Transportation's Incremental Train Control system ("ITCS"), typically use interlocked routes that form one dimensional rail paths. In other words, a train's path is described as a series of mile posts between starting and ending points. In contrast, rail terrain and maps are typically presented in two- or three-dimensional maps. At control points such as switches, sidings, stations, etc., the train may traverse alternate track segments depending on traffic and track resulting track availability. From a train point of view, the route it is to traverse is still along a one dimensional line. For situations where route reentry is possible, such as loops, the subsequent route and associated block occupancy is equal as previous, with a change in direction. Representation in a continuous one-dimensional system is difficult to achieve. In the case of parallel tracks with entry control points, differentiation in a one dimensional space is not possible a priori and both optional tracks would have to be interlocked. Furthermore, with most ATO systems, a continuous route is plotted prior to departure. This makes the accommodation of alternate route entries difficult.

Alternatively, the interlocking and route selection can be performed in a two- or three-dimensional space representation. This, however, requires that the location determination system on the train is capable of accurately determining location in all three dimensions on a continuous basis. In case of location determination systems such as Global Positioning System ("GPS"), altitude determination is less accurate than "X" and "Y" position determination. Additionally, in case of loss of GPS signal, the train location determination system has to revert to alternate means, such as inertial systems which are expensive, or distance calculation based on axle tachometers and the like. In the latter case, the three-dimensional location system has to transform the data to a one-dimensional system for handoff which then includes the errors in the three-to-one dimensional translation.

BRIEF DESCRIPTION OF THE INVENTION

These and other shortcomings of the prior art are addressed by the present invention, which provides a method and apparatus for efficiently translating a two- or three-dimensional route to a one-dimensional route.

According to one aspect of the invention, a method is provided for operating a train or other rail vehicle along a railway which is logically divided into a plurality of segments, the railway including at least one control point at which the railway presents at least two possible paths that are exclusive of each other, each path including one or more segments. The method includes: (a) controlling the rail vehicle as it travels along the railway by reference to a one-dimensional representation of the segments prior to the control point; (b) determining which segment located immediately past the control point is to be occupied by the rail vehicle; (c) after the rail vehicle has traveled past the at least one control point, verifying which segment has been occupied; (d) interlocking the occupied segment; (e) passing segment information to the rail vehicle; and (f) controlling the rail vehicle as it travels along the railway in reference to a one-dimensional representation of the segments past the control point.

According to another aspect of the invention, a method is provided for operating a train or other rail vehicle along a railway which is logically divided into a plurality of segments, the railway including at least one control point which presents at least two possible paths that are exclusive of each other, each path having one or more segments. The method includes: (a) controlling the rail vehicle as it travels along the railway in reference to a one-dimensional representation of the segments prior to the control point; (b) interlocking all of the segments located immediately past the control point; (c) after the rail vehicle has traveled past the at least one control point, determining which segment has been occupied; (d) passing segment information to the rail vehicle; (e) releasing all of the segments located immediately past the control point except the occupied segment; and (f) controlling the rail vehicle as it travels along the railway in reference to a one-dimensional representation of the segments past the control point.

BRIEF DESCRIPTION OF THE DRAWINGS

The invention may be best understood by reference to the following description taken in conjunction with the accompanying drawing figures in which.

DETAILED DESCRIPTION OF THE INVENTION

Figure 1:
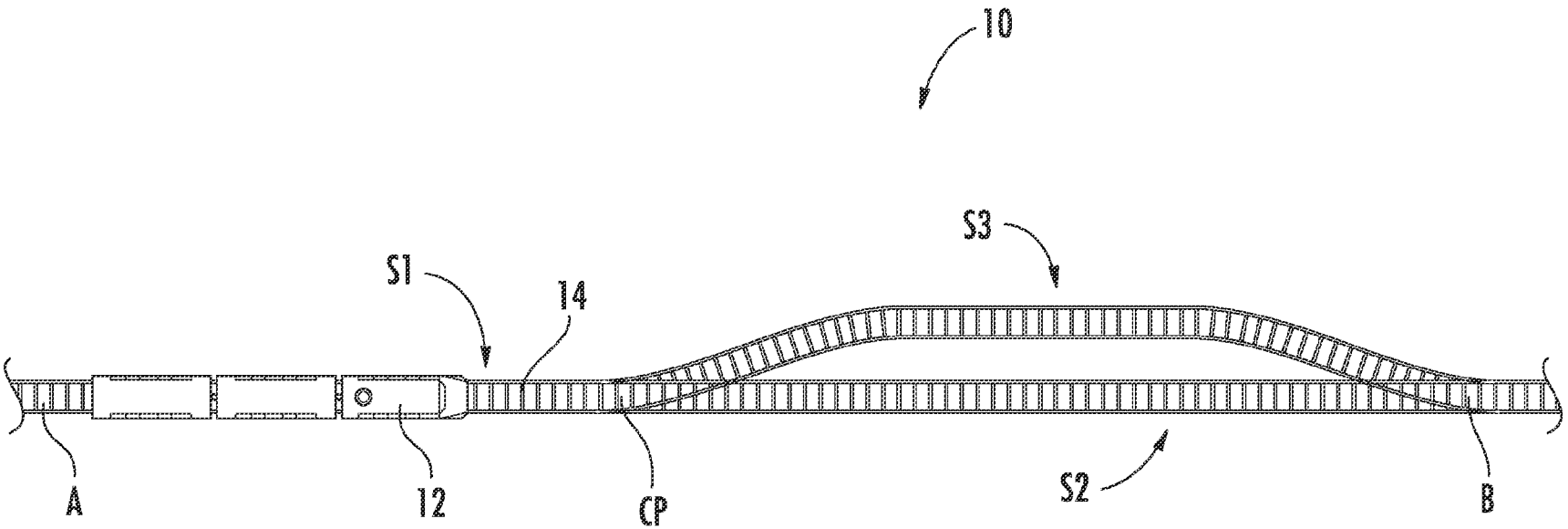
FIG. 1 is a schematic view of a portion of a railroad track with various route segments.

Referring now to the drawings wherein identical reference numerals denote the same elements throughout the various views, FIG. 1 depicts a portion of a railway 10 with a train 12 (or other rail vehicle) on the track 14.

For the purposes of the present invention the railway 10 may be logically divided into a plurality of segments. ("Logically" divided means divided at least for control purposes, and not necessarily a physical boundary or division.) Each segment represents the track's path between control points, such as switches, sidings, stations, etc. For example, a first segment "S1" extends between point "A" and control point "CP", which in this example is located at a switch. A second segment "S2" extends between control point CP and point "B". A third segment "S3" is a parallel track or siding, and extends between control point CP and point B, but along a different path than segment S2. The switch can direct the train 12 to either segment S2 or S3 depending on how it is set.

The train 12 is part of an ATO system. Several such systems are known in the prior art and will not be described in extensive detail here. One example is described in U.S. Pat. No. 5,533,695 to Heggestad, et al. entitled "Incremental Train Control System."

Figure 2:
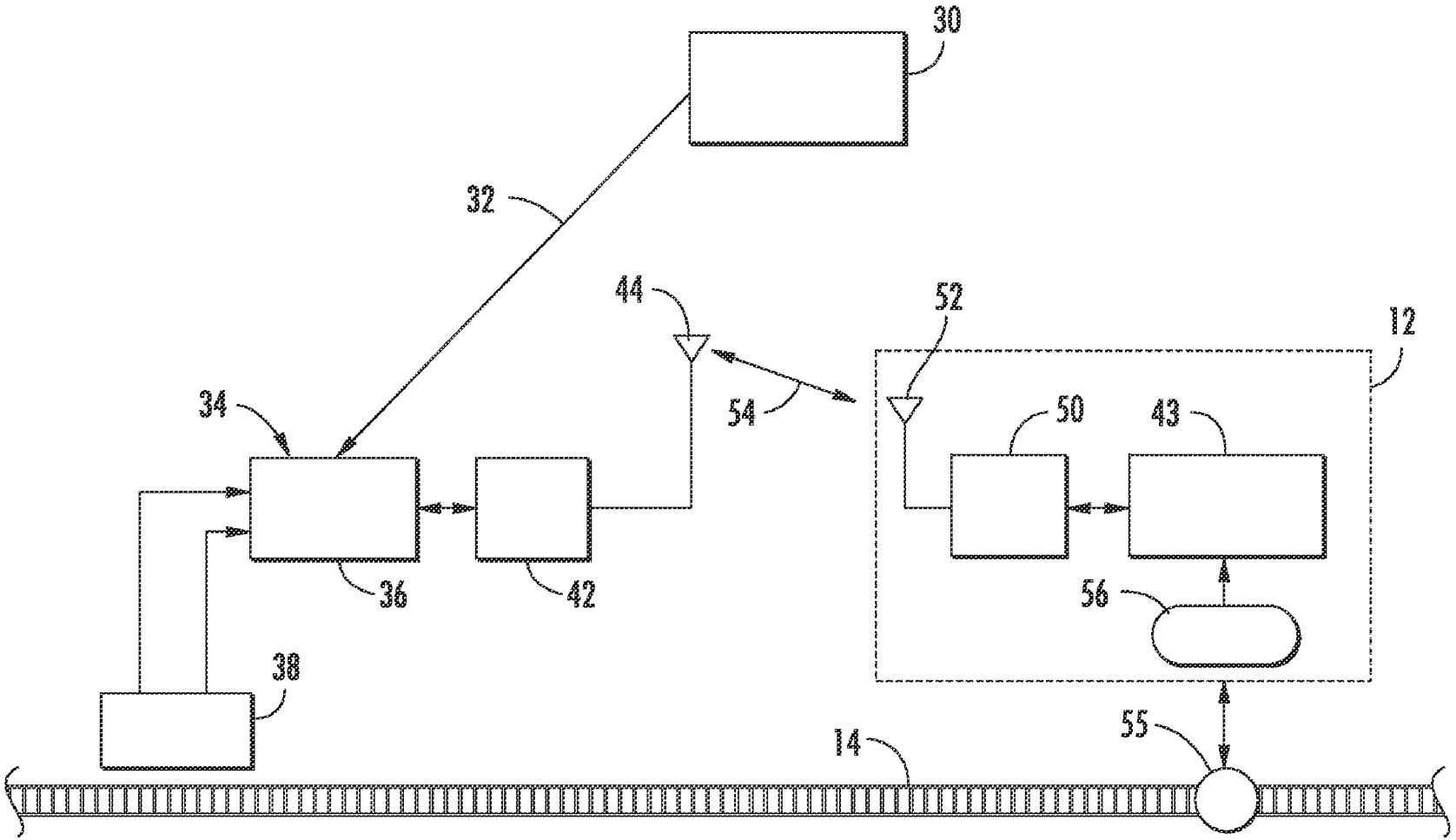
FIG. 2 is a schematic view of the components of an automatic train operation system.

The basic components of that system are shown for reference in FIG. 2. An optional central control office facility 30 has master fixed data files stored in a central computer which contain all data relating to the profile of a route under control. This fixed data comprises, in effect, a library of information that will in normal circumstances remain unchanged for the route. In addition to timetable speed limits and civil speed restrictions, the fixed data files may include such information as the location of track under repair and an appropriate temporary slow order, the location of critical locations and any other points at which a control action may be required. A dispatcher data line 32 connects the central control 30 with a wayside control unit generally designated 34 which includes, as elements thereof, a wayside interface unit (WIU) 36, vital logic 38 associated with a particular location on a rail line 14, and a data radio 42 having an antenna 44. A series of wayside control units 34 are spaced along the track under control at interlockings and special detection sites and are in communication with central control 30 via their respective dispatcher data lines 32, or other appropriate data communications channel, such as a wireless channel. Accordingly, relevant portions of the master fixed data files are downloaded from central control 30 to the wayside control units 34 via respective data lines 32 so that each wayside control unit has the profile of the particular local area of the route under its control.

The vital logic 38 typically comprises existing track circuits and signal circuits associated with a wayside signal. Therefore, the WIU 36 utilizes this signal and track status information to provide the dynamic data that comprises an authority message (in effect, "virtual signals") transmitted by data radio 42. "Virtual signal" and "virtual signal state" refer to railway signals communicated other than from a wayside signal directly to a passing train.

FIG. 2 also illustrates a train 12 by the symbol in broken lines showing train movement from right to left in the illustration. In the locomotive a speed monitoring and enforcement on-board computer (OBC) 43 receives profile and authority messages from the wayside control unit 34 via a data radio 50 having an antenna 52. An arrow 54 illustrates the radio link between the data radio 42 of the wayside control unit 34 and the on-board data radio 50.

The train 12 is shown (schematically) in FIG. 2 at a trackside transponder 55 on the rail line 14. The transponder 55 is a passive beacon transponder that is interrogated by a passing train as illustrated by the interrogator antenna 56 which is typically mounted adjacent the underside of the locomotive. Transponder 55 is of the type that, when interrogated, responds with a serial data message bearing a location reference such as a milepost number. As will be discussed in detail below, the on-board computer 43 merges this train location information with the fixed and dynamic data received via radio link 54 to determine the proper train control instructions. Other means of determining the location of the train 12 may be employed, for example using axle tachometers or other distance measuring equipment, inertial systems, LORAN, or GPS.

The OBC 43 is then operable to control the operation of the train 12 by prompting the driver, by applying the brakes directly to meet braking targets, or a combination thereof. As an alternative to the ATO system described above, a wayside-based system may be used. In this case wayside devices store the local segment options and determine paths and perform interlocking by using optimization locally with feedback from both the train 12 and a central authority or "back office." Also possible is a vehicle-based system, where individual trains 12 store the route segments and get authorization from wayside devices to combine via interlocking requirements from the train 12; the train 12 optimizes with feedback from wayside devices a central authority or "back office". The exact functions and architecture of the particular ATO system are not critical; what is important is that ATO systems typically refer to a one-dimensional route map in operation. This route disregards direction and elevation changes which occur in actual operation. It is also noted that, while the present application describes virtual block systems, the route translation system is also applicable to conventional block systems, systems using track occupancy such as DC and AC track circuits, as well as a mix of virtual and conventional systems. The present invention provides a system for translating a two- or three-dimensional map which has route alternates to a one-dimensional route map suitable for use by an existing ATO system. The route translation system may be implemented in various ways. It may be an add-on software module to the existing OBC 43; or it may operate on a separate processor or processors connected in communication with the OBC 43. The processing may also be performed off-board the train 12.

Figure 3:
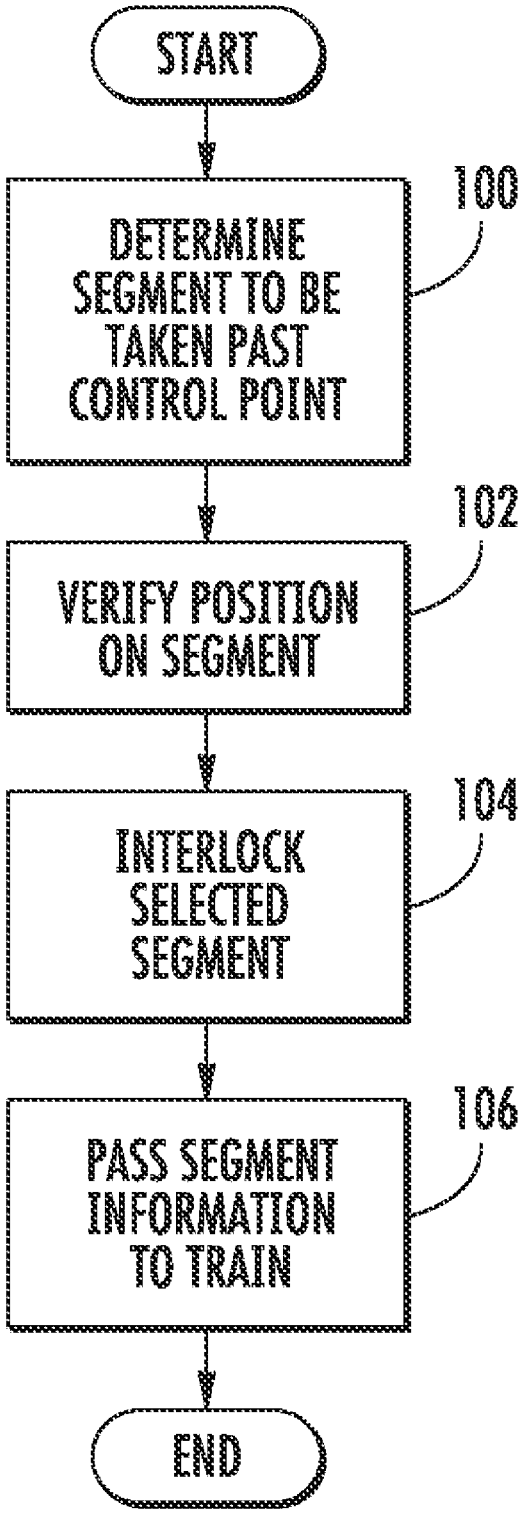
FIG. 3 is a block diagram illustrating a method of route translation according to an aspect of the present invention.

With reference to FIG. 3, the route translation system functions as follows. At departure and train integrity check, a preferred initial route is entered to the OBC 43. The initial route segments required for train travel based on the train information are assigned to the train and marked as occupied (i.e. "interlocked").

The route translation system stores information for all of the possible route segments. The information includes a translation of available two-dimensional or three-dimensional route information about the segment into a one-dimensional route (i.e. with all information indexed to mileposts or distance traveled), as well as the operational rules of the railroad. However, there is no need to store every possible route (i.e. each specific sequence of segments).

The train 12 begins operation under the control of the ATO system. As the train 12 traverses the permitted block and approaches a control point that presents at least one alternate path for the train, the ATO system assigns the train 12 the appropriate path given the operational rules of the railroad (block 100). These rules may include maximum speed given a train type, train priority, occupancy of alternate routes by other trains, fuel efficiency, emission performance, health of the train 12 in question or health of alternate trains in consideration, crew information, time of arrival, cargo information, wayside maintenance inputs, etc. For example, at control point "CP" in FIG. 1, the train 12 may take segment S2 or S3.

Until the train reaches the control point CP the one-dimensional distance counter internal to the OBC 43 increments and is cross checked by the location determination system. In case of a GPS system, the translation of 2D or 3D position information to a one-dimensional route is known in the art. In case of GPS signal obstruction, path propagation may be performed by alternate means such as axle tachometers, inertial system, etc.

The ATO system determines the subsequent path of the train 12 after it passes the control point CP (block 102). The path could be determined by various means including feedback from a wayside device (e.g. a reported position of a switch at the control point CP), axle tachometers or other distance measuring equipment, off-board transponders (e.g. radio mileposts), inertial, LORAN, or GPS. The location determination need only be accurate enough to determine which of two or more discrete route segments has been taken. Once the train 12 has passed the control point CP, it sets the control point CP as appropriate and interlocks it and the occupied segment which is located immediately past the control point (block 104). It is also possible for the system to interlock multiple route segments past the control point CP. The ATO system then communicates, at block 106, the (virtual) signal states to the train 12, for example through the WIU 36. The train location determination system downloads and assigns the expected length and location determination translation (i.e. GPS to one-dimensional system) given the assigned train route. The train 12 then continues in operation with the ATO controlling it in reference to a one-dimensional route. The process repeats as each subsequent control point is encountered.

Figure 4:
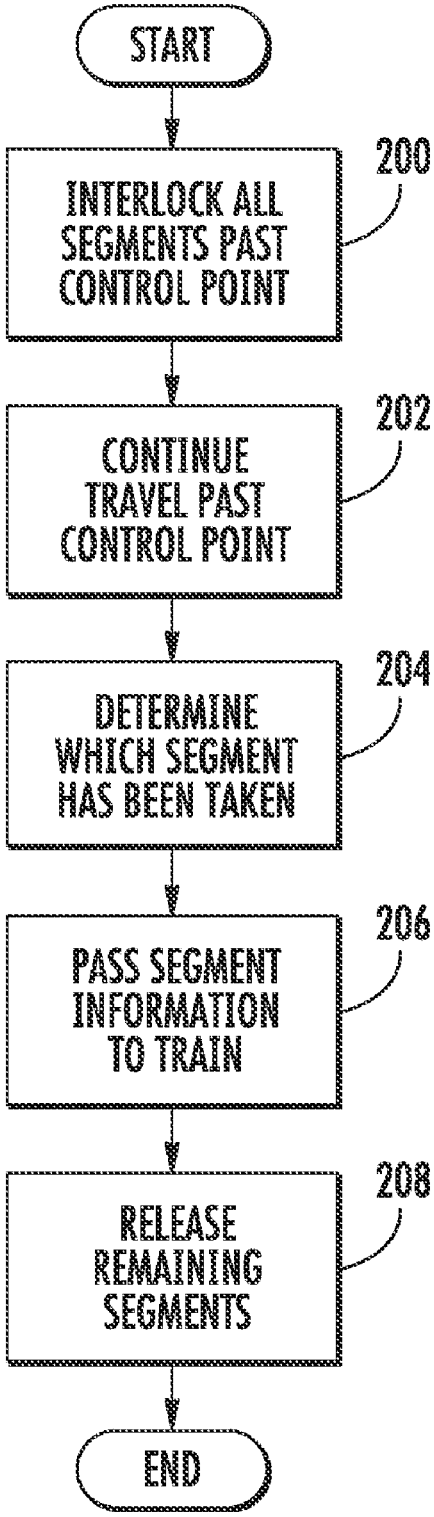
FIG. 4 is a block diagram illustrating an alternative method of train route translation according to another aspect of the present invention.

FIG. 4 illustrates an alternative procedure. At block 200, prior to reaching a control point CP, and within a safe stopping distance for the train 12, all route segments located immediately past the control point CP are interlocked (blocked). It is possible for the system to interlock multiple downstream route segments past the control point CP. The train 12 then continues to travel past the control point CP (block 202).

Next, at block 204, it is determined which route segment the train 12 is on. The location could be determined by various means including feedback from a wayside device (e.g. a reported position of a switch at the control point CP), axle tachometers or other distance measuring equipment, off-board transponders (e.g. radio mileposts), inertial, LORAN, or GPS. The location determination need only be accurate enough to determine which of two or more discrete segments has been taken.

Once the proper route segment has been identified, the train location determination system downloads and assigns the expected length and location determination translation (i.e. GPS to one-dimensional system) for the appropriate segment (block 206). The train 12 then continues in operation with the ATO controlling it in reference to a one-dimensional route. The remaining route segments may be safely released, at block 208. The process then repeats as each new control point CP is encountered.

In addition to the functions described above, it is also possible for the route translation system to store records of the routes taken and to "learn" which approaches are preferred over time. This information may be used to determine not only the next route after each control point, but also subsequent route segments.

The system described above allows real time update of a one-dimensional track route by breaking the route into segments and concatenates these given the options available. Given the control point position knowledge and predetermined route segment knowledge, route occupancy and location determination approach can be handled in one dimensional space for a given train route, as well as alternate route segments, while requiring only limited positional accuracy.

Although certain embodiments have been described herein as relating to trains, the invention is applicable to rail vehicles generally, i.e., a vehicle that travels on one or more rails.

While the invention has been described in what is presently considered to be a preferred embodiment, many variations and modifications will become apparent to those skilled in the art. Accordingly, it is intended that the invention not be limited to the specific illustrative embodiment.

What is claimed is:

1. A method of operating a rail vehicle along a railway which is logically divided into a plurality of segments, the railway identified in part by a two and/or three dimensional map, the railway including at least one control point at which the railway presents at least two possible paths that are exclusive of each other, each path comprising one or more segments, the method comprising:

determining an initial route for operating the rail vehicle along a railway, the route comprising a plurality of segments;

translating a two or three dimensional map of at least a portion of the railway having path alternatives into a one-dimensional route map suitable for use by an existing Automatic Train Operation (ATO) system;

storing information for all possible route segments, the information including the one-dimensional route map for the respective segment;

controlling the rail vehicle via an ATO system as it travels along the railway by reference to the one-dimensional route map of the segments prior to the control point;

after the rail vehicle has traveled past the at least one control point, verifying which segment has been occupied;

interlocking the occupied segment;

passing segment information to the rail vehicle; and controlling the rail vehicle via the ATO system as it travels along the railway in reference to the one-dimensional route map of the segments past the control point.

2. The method of claim 1 wherein the information pertinent to the occupied segment is one or more virtual signal states of segments located past the control point.

3. The method of claim 1 wherein the segment information is a one-dimensional representation of segments located past the control point.

4. The method of claim 1 wherein the rail vehicle is controlled by an on-board computer.

5. The method of claim 1 wherein the at least one control point is a track switch.

6. The method of claim 1 wherein the step of interlocking further comprises interlocking additional segments downstream of the occupied segment.

7. The method of claim 1 wherein the step of verifying which segment is occupied is carried out by reference to a wayside device.

8. The method of claim 1 wherein the step of verifying which segment is occupied is carried out using a location determination system internal to the rail vehicle.

9. A method of operating a rail vehicle along a railway which is logically divided into a plurality of segments, the railway including at least one control point which presents at least two possible paths that are exclusive of each other, each path comprising one or more segments, the method comprising:

(a) controlling the rail vehicle as it travels along the railway in reference to a one-dimensional representation of the segments prior to the control point;

(b) interlocking all of the segments located immediately past the control point;

(c) after the rail vehicle has traveled past the at least one control point, determining which segment has been occupied;

(d) passing segment information to the rail vehicle;

(e) releasing all of the segments located immediately past the control point except the occupied segment; and (f) controlling the rail vehicle as it travels along the railway in reference to a one-dimensional representation of the segments past the control point.

10. The method of claim 9 wherein the segment information is one or more virtual signal states of segments located past the control point.

11. The method of claim 9 wherein the segment information is a one-dimensional representation of segments located past the control point.

12. The method of claim 9 wherein the rail vehicle is controlled by an on-board computer.

13. The method of claim 9 wherein the at least one control point is a track switch.

14. The method of claim 9 wherein step (b) further comprises interlocking additional segments downstream of the segments located immediately past the control point.

15. The method of claim 9 wherein step (c) is carried out by reference to a wayside device.

16. The method of claim 9 wherein step (c) is carried out using a location determination system internal to the rail vehicle.

17. The method of claim 9 further comprising steps (a)-(f) at successive control points along the railway.

* * * * *